US005485998A

United States Patent [19]

Kobayashi

[11] Patent Number: 5,485,998

[45] Date of Patent: Jan. 23, 1996

[54] GOLF CLUB HEAD

[75] Inventor: Kenji Kobayashi, Tsubame, Japan

[73] Assignee: Kabushiki Kaisha Endo Seisakusho, Japan

[21] Appl. No.: 291,188

[22] Filed: Aug. 16, 1994

[30] Foreign Application Priority Data

Jul. 20, 1994 [JP] Japan ..... 6-168400

[51] Int. Cl.[6] ..... A63B 53/04

[52] U.S. Cl. ..... 273/80.2; 273/167 H; 273/171

[58] Field of Search ..... 273/167 R, 167 H, 273/167 F, 169, 80.2, 167 J, 167 K, 78, 170, 171, 172, 173, 175, 193 R, 194 R

[56] References Cited

U.S. PATENT DOCUMENTS

| | | | |
|---|---|---|---|
| 4,214,754 | 7/1980 | Zebelean | 273/167 H |
| 4,432,549 | 2/1984 | Zebelean | 273/167 H |
| 4,438,931 | 3/1984 | Motomiya | 273/80.2 |
| 5,028,049 | 7/1991 | McKeighen | 273/167 H |
| 5,232,224 | 8/1993 | Zeider | 273/167 H |
| 5,282,624 | 2/1994 | Viste | 273/167 H |

FOREIGN PATENT DOCUMENTS 61-33972 10/1986 Japan .

OTHER PUBLICATIONS

"Golf Digest", May 15, 1992, Matsuo Article, pp. 60–65.

*Primary Examiner*—Sebastiano Passaniti
*Attorney, Agent, or Firm*—Quarles & Brady

[57] ABSTRACT

A golf club head having a high strength and a larger sweet area, which is provided by using light metal such as titanium or titanium alloy. A face crust, an upper crust, a sole and side-peripheral crust are combined together with a neck to form a golf club head. Each crust is formed by forging metal plate of titanium or titanium alloy. The thickness of each crust is adjusted to suitably enlarge a volume of a hollow interior of a golf club head. The hollow interior has a volume of 240 cc or above. According to the invention, the hollow interior of the head is suitably enlarged, ensuring the structural strength of a golf club head so that the distance L between the center of gravity G of the head and the face thereof may be elongated, whereby the sweet area can be enlarged.

3 Claims, 4 Drawing Sheets

GOLF CLUB HEAD

BACKGROUND OF THE INVENTION (a) Field of the Invention

The present invention relates to a hollow golf club head such as so-called "metal wood", which is provided by integrally combining a plurality of crusts.

(b) Description of Prior Art

One of the representative of conventional hollow golf club heads is proposed in Japanese Utility Model Publication No. 61-33972, of which the FIG. 1 shows a golf club head comprising three crusts,i.e., a face crust, an upper crust and a sole and side-peripheral crust to be integrally combined, thus optionally adjusting a position of the center of gravity of a golf club head.

According to the conventional golf club head, however, there has been a problem such that in the event of using iron as materal of the crusts, comparatively a large specific gravity of iron has prevented the enlarging of the bulk or volume of the head body within a specified value, thus disenabling the elongating of a distance between the center of gravity of a head body and its face, so that so-called sweet area on the face cannot be sufficiently enlarged.

One of a means for solving the above problem may be, for example, a lost wax process in which fused light metal such as titanium or titanium alloy melt is poured into a mold to form each crust. However, such process is relatively inferior in the strength of each crust, thus preventing the enlarging of a volume of a golf club head.

SUMMARY OF THE INVENTION

To eliminate the above-mentioned problems, it is, therefore, an object of the present invention to provide a golf club head, which is formed strongly by using titaniun or titanium alloy.

According to a major feature of the present invention, there is provided a golf club head having a hollow interior defined by a face, an upper surface, a sole and side-peripheral surface and a neck, comprising a plurality of crusts corresponding to the face, the upper surface and the sole and side-peripheral surface respectively, which are to be forged and combined integrally so that a thickness of the face may be 2.5 mm or below, a thickness of the upper surface be 1.0 mm or below and a thickness of the sole and side-peripheral surface be 1.2 mm or below respectively.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Figure 1:
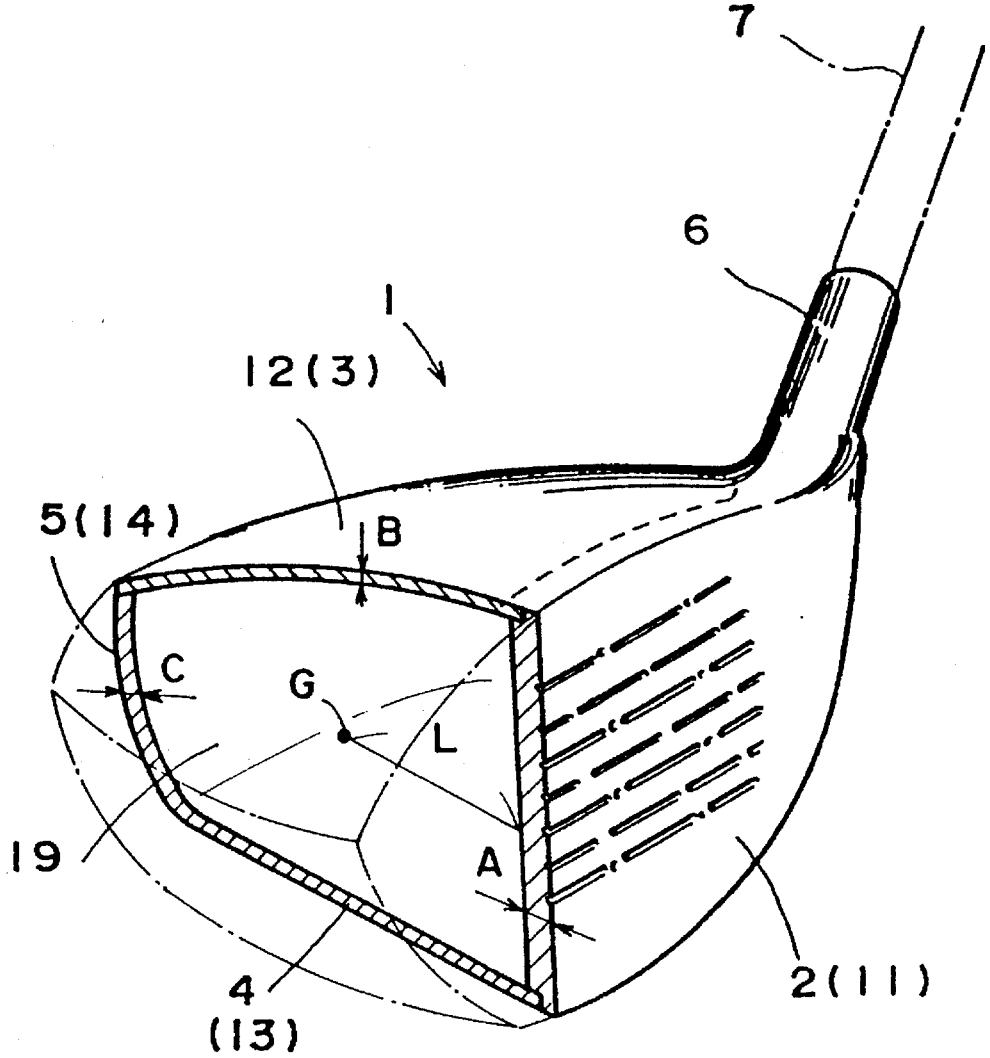
FIG. 1 is a cut in part perspective view showing an embodiment of the invention.
Figure 2:
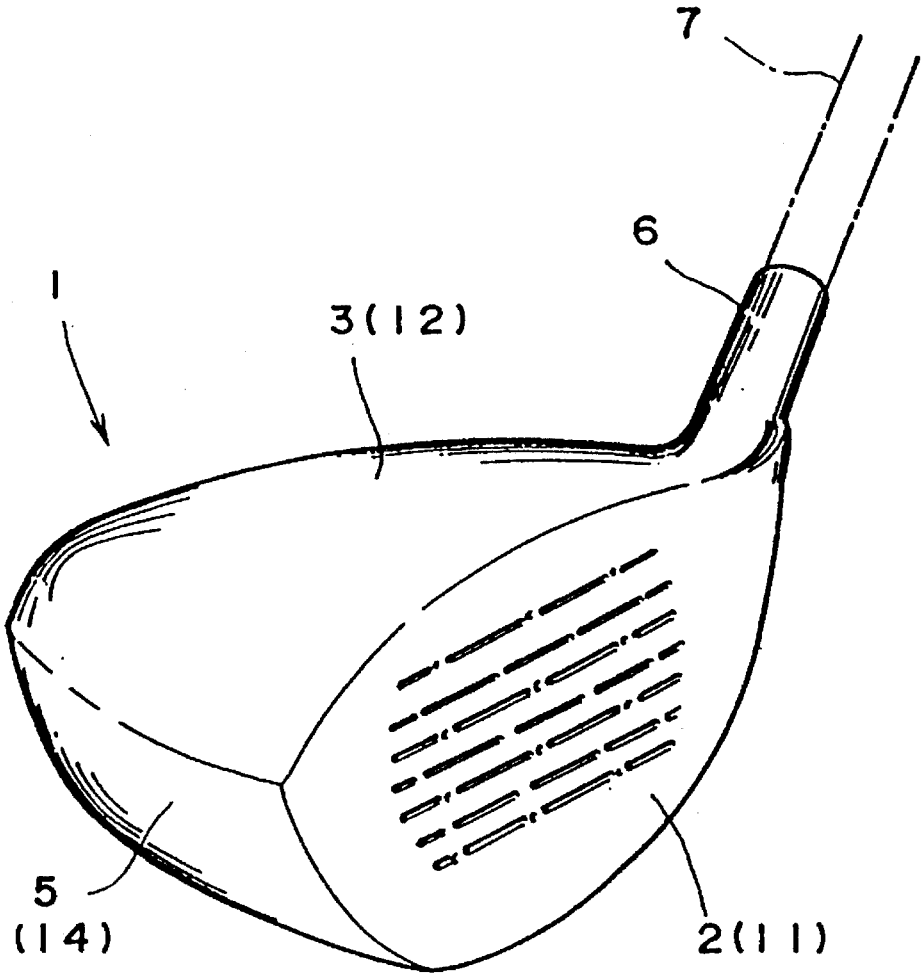
FIG. 2 is a perspective view showing an embodiment of the invention.
Figure 3:
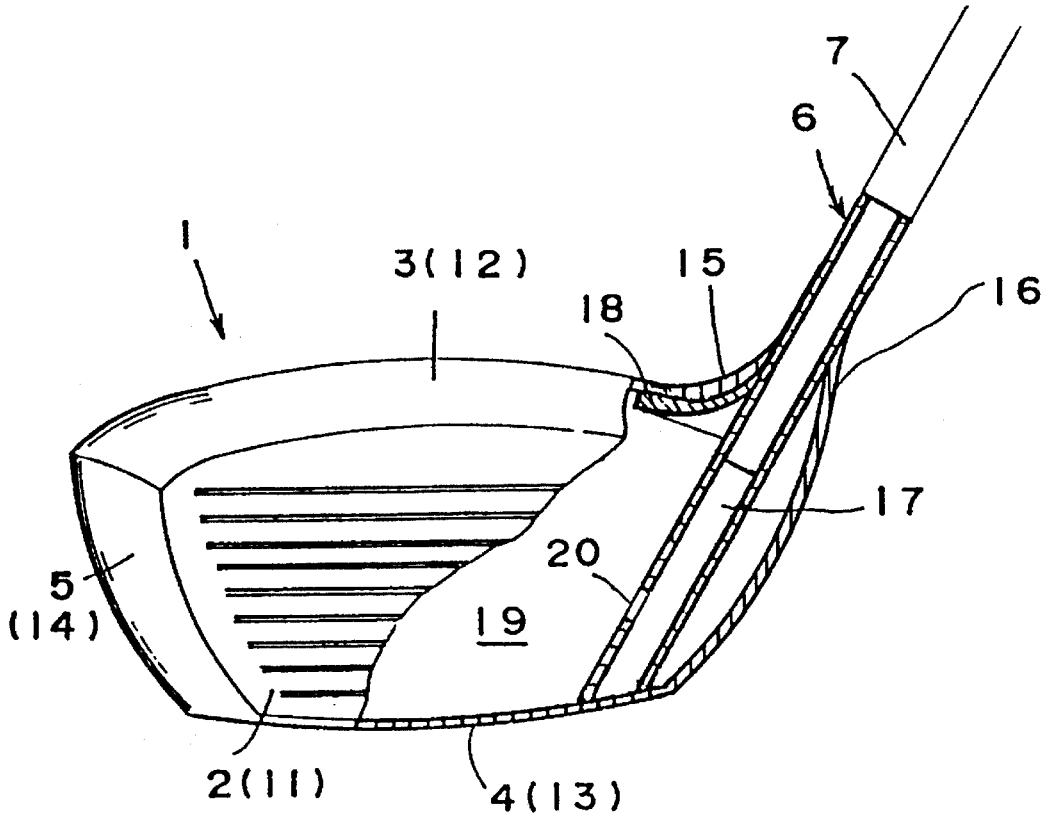
FIG. 3 is a cut in part front view showing an embodiment of the invention.
Figure 4:
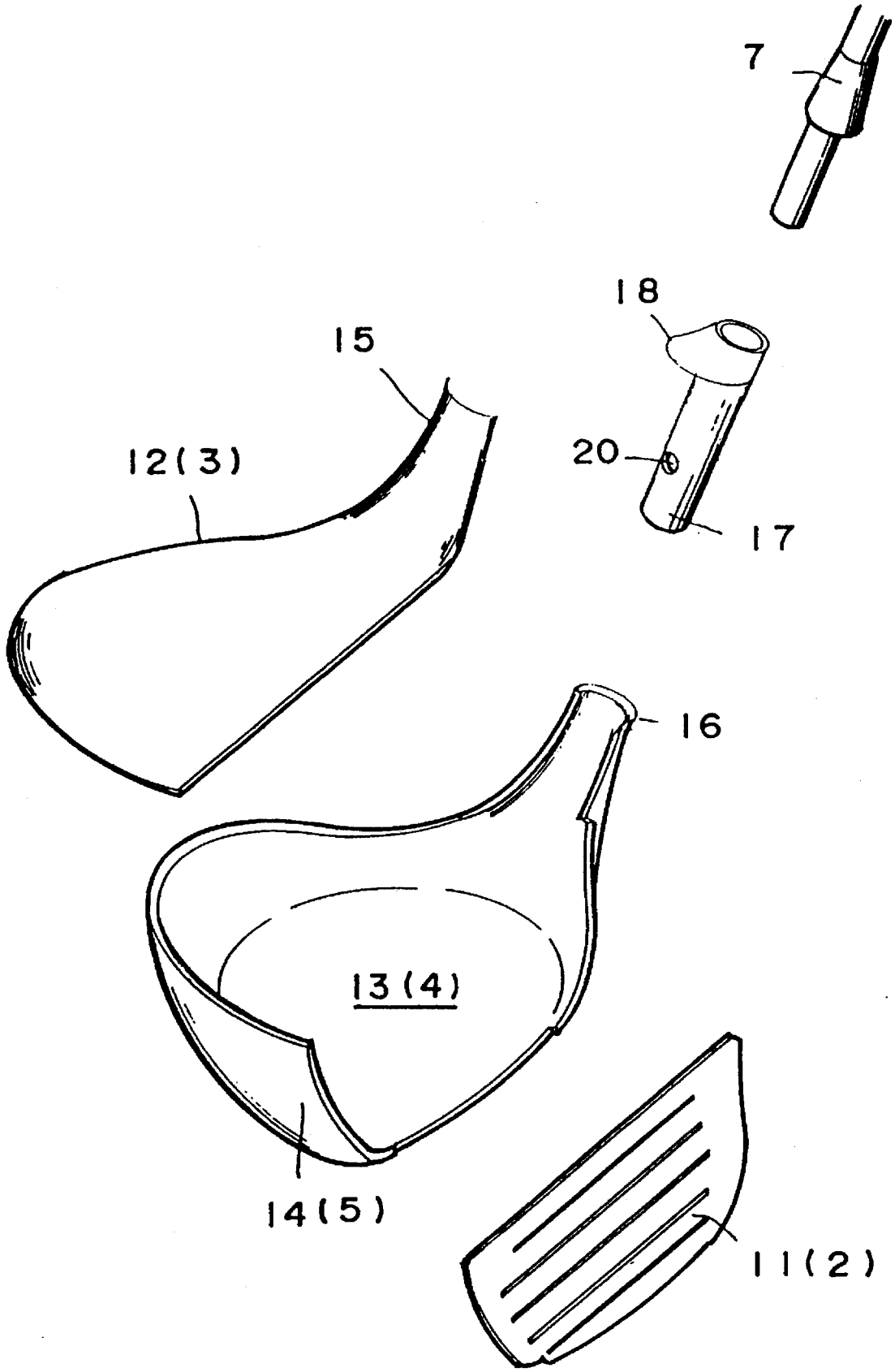
FIG. 4 is an exploded perspective view illlustrating an embodiment of the invention.

Hereinafter is described an embodiment of the invention with reference to FIGS. 1 to 4. As shown in FIG. 2, 1 designates a golf club head (hereinafter called head) comprising a face 2, so-called crown or upper surface portion 3, a sole (4) and side-peripheral portion 5 and a neck 6 for connecting a shaft 7 thereto.

The head 1 is formed by integrally combining a face crust 11, an upper crust 12, a sole (13) and side-peripheral crust 14 by welding each edge thereof, said each crust corresponding to plural, or preferably, three separate portions such as the face 2, the upper surface portion 3, the sole (4) and the side-peripheral poriton 5 respectively. The face crust 11, upper crust 12, sole crust 13 and side-peripheral crust 14 are formed by forging metal plate of (pure) titanium or titanium alloy.

The thickness A of the face portion 2 is formed 2.5 mm or below, preferably 1.5 to 2.5 mm when forging the face crust 11 into the face portion 2. The thickness B of the upper surface portion 3 is formed 1.0 mm or below, preferably 0.5 to 1.0 mm when forging the upper surface crust 12 into the upper surface portion 3. The thickness C of the sole portion 4 and side-peripheral portion 5 is formed 1.2 mm or below, preferably 0.5 to 1.2 mm when forging the sole crust 13 and side-peripheral crust 14 into the sole 4 and side-peripheral portion 5. After having integrally combined the face crust 11, upper crust 12, sole crust 13 and side-peripheral crust 14 together, heat treatment is carried out so that the hardness of each crust 11,12,13 and 14 will be 50 or above scale value according to Rockwell hardness tester scale C ($H_RC$).

From one side of the face crust 11, there extends obliquely upward one half of the neck crust 15 forming one half of the neck 6, while from one side of the side-peripheral crust 14, there extends the other half of the neck crust 15 forming the other half of the neck 6. Then, the edges of the half neck crusts 15,16 are welded to each other to be integrally combined with the face crust 11 and the like. Into the neck 6 thus formed by the half neck crusts is inserted a shaft mounting pipe 17 for mounting the shaft 7 to the neck 6. An upper part of the pipe 17 is formed with a mounting protrusion 18, which is secured to an inside surface of the upper crust 12 by welding or the like.

In a preferred form of the invention, the volume of a hollow interior of the head 1 integrally formed by combining the face crust 11, upper crust 12, sole 13 and side-peripheral crust 4 respectively is 240 cc or above, preferably 240 to 350 cc.

Incidentally, there is provided a through-hole 20 at the lower part of the mounting pipe 17, from which can be injected foam materal (not shown) into the hollow interior 19 where necessary.

Hereinafter is described an action of the above-described structure.

As described above, the thickness A of the face 2 is adjusted to 2.5 mm or below, and the thickness B of the the upper surface portion 3 is 1.0 mm or below, while the thickness C of the sole 4 and side-peripheral portion 5 is 1.2 mm or below respectively by forging, thus generating a grain flow in each crust 11,12,13 and 14. Grain flow is a fiber structure of metallic material which is disposed along a surface thereof by forging the metallic material to a predetermined thickness, thereby enhancing strength of each shell against external force. As each of such reinforced shell is integrally combined to form a golf club head, the strength of such golf club head can be also improved as a result. As a result, the structural strength of the head 1 can be improved. In addition, each portion 2,3,4 and 5 having a high strength permits its each thickeness to be decreased enough to enable the lightening of the head 1, whereby the hollow interior 19 of the head 1 is enlarged so as to elongate the distance L between the center of gravity G of the head 1 and the face 2 thereof. Consequently, the sweet area on the face 2 is enlarged. Further, the thickness A is the greatest, while the thickness B the least (i.e.,A>C>B), corresponding to a requirement to each portion for strength, whereby the head 1 can be further effectively lightened and enlarged.

However, in the case of the thickness A of the face 2 being greater than 2.5 mm, and the thickness B of the upper surface portion 3 greater than 1.0 mm, while the thickness C of the sole 4 and side-peripheral poriton 5 greater than 1.2 mm, the above-mentined effects cannot be attained.

In a preferred form of the invention, the thickness A of the face 2 is 1.5 to 2.5 mm, and the thickness B of the upper surface portion 3 is 0.5 to 1.0 mm, while the thickness C of the sole 4 and side-peripheral portion 5 is 1.0 to 1.2 mm, whereby the sweet area on the face 2 can be most suitably enlarged. However, in the case that the thickness A of the face 2 is less than 1.5 mm, and the thickness B of the upper surface portion 3 less than 0.5 mm, while the thickness C of the sole 4 and side-peripheral poriton 5 is less than 1.0 mm respectively, there will be some fear of insufficient strength of the head 1 in hitting balls.

Further, according to the invention, the hollow interior 19 of the head 1 surrounded by the combined crusts 11,12,13 and 14 has a volume of 240 cc or above, whereby the distance L between the center of gravity G of the head 1 and the face 2 thereof can be elongated so that the sweet area thereon can be enlarged. However, in the case that a volume of the hollow interior 19 is less than 240 cc, the distance L cannot be sufficiently enlarged. As a result, the sweet area cannot be enlarged.

In a preferred form of the invention, the volume of the hollow interior 19 is 240 to 350 cc, thus most suitably enlarging the sweet area. Further, with the volume 350 cc or below, the air resistance of the head 1 can be kept within an allowable value.

Furthermore, as the head 1 is formed by combining preferably three crusts, i.e., the face crust 11, upper surface crust 12, and integral sole crust 13 and side-peripheral crust 14, they are easy to be forged, having such simple configurations that welding operation can be easily carried out, thereby resulting in easy fabrication thereof.

In addition, the hardness of each crust 11,12,13,14,15 and 16 is 50 or above scale value according to the Rockwell hardness tester scale ($H_RC$), thus can be provided a head 1 which has a preset hardness and is hard to be scarred. Particulary, it should be noted that the hardness with the scale value $H_RC$ of 50 or above can prevent the damage to the face crust 11 when hitting balls.

Additionally, in a preferred embodiment of the invention, inside the hollow interior 19 is integrally provided a shaft mounting pipe 17 connected to the neck 6, said pipe 17 being provided with the mounting protrusion 18 connected to the lower surface of the upper crust 12, whereby the shaft 7 can be securely connected to the head 1 through the shaft mounting pipe 17, thus enlarging the connection strength between the head 1 and the shaft 7.

Incidentally, the present invention should not be limited to the above-described embodiment, but can be modified within a scope of the invention. For example, the head body may be formed of four or more crusts such as a face crust, an upper crust, a sole and side-peripheral crust and a neck crust corresponding to a face, an upper surface portion, a sole and side-peripheral portion and a neck of a golf club head. Further, the hollow interior may be charged with foam material.

What is claimed:

1. A golf club head having a hollow interior defined by a face, an upper surface and a sole and side-peripheral surface, comprising;

three separate metal crusts corresponding to the face, the upper surface and the sole and side-peripheral surface respectively, which are to be forged and combined integrally so that a thickness of the face may be 1.5 to 2.5 mm, a thickness of the upper surface be 0.5 to 1.0 mm and a thickness of the sole and side-peripheral surface be 1.0 to 1.2 mm respectively, said hollow interior having a volume of 240 to 350 cc; and a shaft mounting pipe integrally provided inside the hollow interior, connected to said neck of a golf club head, said shaft mounting pipe being provided with a mounting protrusion connected to a lower surface crust of the upper crust.

2. A golf club head according to claim 1, wherein the hardness of each metal crust is 50 or above at scale value according to Rockwell hardness tester scale C.

3. A golf club head according to claim 1, wherein each metal crust is made of titanium or titanium alloy.

* * * * *

UNITED STATES PATENT AND TRADEMARK OFFICE

CERTIFICATE OF CORRECTION

PATENT NO. : 5,485,998

DATED : January 23, 1996

INVENTOR(S) : Kobayashi

It is certified that error appears in the above-identified patent and that said Letters Patent is hereby corrected as shown below:

In column 4, line 39, replace "said" with --a--.
line 39, replace "a golf" with --said golf--.
41, delete "crust".
42, after "upper" insert --surface--.

Signed and Sealed this

Thirtieth Day of July, 1996

Bruce Lehman

*Attest:*

BRUCE LEHMAN

*Attesting Officer*

*Commissioner of Patents and Trademarks*